United States Patent [19]

Murakami et al.

[11] Patent Number: 4,839,732

[45] Date of Patent: Jun. 13, 1989

[54] APPARATUS AND METHOD FOR TRANSPORTING AND CUTTING A RECORDING MEDIUM

[75] Inventors: Syogo Murakami, Hino; Takashi Shimmyo, Musashino, both of Japan

[73] Assignee: Kabushiki Kaisha Toshiba, Tokyo, Japan

[21] Appl. No.: 18,553

[22] Filed: Feb. 25, 1987

[30] Foreign Application Priority Data

Feb. 25, 1986 [JP] Japan ..... 61-38229

[51] Int. Cl.[4] ..... H04N 1/21

[52] U.S. Cl. ..... 358/304; 355/310

[58] Field of Search ..... 346/24, 76 PH; 355/13; 358/304, 256, 285.6, 289, 291, 293, 300

[56] References Cited

U.S. PATENT DOCUMENTS 4,112,497 10/1978 Suzuki et al. ..... 358/304
4,646,162 2/1987 Sue ..... 353/13
4,707,704 11/1987 Allen et al. ..... 358/304

*Primary Examiner*—E. A. Goldberg

*Assistant Examiner*—Lincoln Donovan

*Attorney, Agent, or Firm*—Banner, Birch, McKie & Beckett

[57] ABSTRACT

A recording apparatus of the type using a roll of recording paper in which recording paper unrolled from the roll is cut by a cutter after completion of a recording operation and thereby a section of the recording paper on which recording has been effected is cut from the roll is disclosed. The apparatus includes at least one transporting roller before the cutter. After completion of the recording operation, the recording paper is moved forward to a position where the desired cutting point passes through the cutter a predetermined distance. Thereafter the recording paper is moved back by the predetermined distance so the desired cutting point comes into contact with the cutter. The recording paper is then cut and discharged into a tray for storage. Since the paper is pushed into the tray and then moved back before being cut, the possibility of a bend in the paper forcing the cut paper back into the cutter is reduced to thereby eliminate clogging and undersirable double cutting of a single sheet of recorded paper.

13 Claims, 4 Drawing Sheets

APPARATUS AND METHOD FOR TRANSPORTING AND CUTTING A RECORDING MEDIUM

BACKGROUND OF THE INVENTION

1. Field of the Invention

The present invention relates to a recording apparatus and, more paticularly, to an apparatus and method for transporting and cutting a recording medium.

2. Description of the Prior Art

As is well known, a recording apparatus of the type using a roll of recording paper is used in facsimile receivers and other printers. In a typical apparatus, recording paper is unrolled from the roll, transported past a recording head, such as a thermal recording head, and information is recorded on the paper by the recording head. After completion of the recording operation, the recording paper is further transported a predetermined distance and a cutting operation is performed. The section of the recording paper that has been recorded and cut is then stored in a tray.

The most convenient position for the storage tray is immediately adjacent the cutting device since paper that has been cut can fall immediately into the tray. A recurring problem has been found, however, in recording devices thus arranged. As the paper moves into the tray, a bend frequently occurs due to interference between the recording paper and sections of the recording paper that have previously been cut and discharged into the tray. The paper may also bend due to the fact that it has been stored on a roll and is predisposed to a bent configuration. After the cutting operation, this bend will sometimes cause the paper to move back into the cutting device, causing undesirable papr clogging and frequently resulting in the same section of the recording paper being cut more than once. In response to this serious problem, many prior art devices use feed rollers after the cutting device to transport the cut section of the recording paper to a tray located some distance from the cutting device. In this way, the cut paper could not become clogged in the cutting device.

Although the use of feed rollers helped to eliminated the problem of paper clogging, several new and equally disturbing problems were created. Using feed rollers beyond the cutting device requires that the tray and the cutting device be some distance apart. This requirement makes it difficult to manufacture a compact recording device. As the technology of recording devices has improved, the size of the devices has decreased. The use of feed rollers places an unwanted limitation on the size of the device. The use of feed rollers also increases the cost of production and increases the overall complexity of the device which will necessitate additional maintenance and repair.

SUMMARY OF THE INVENTION

It is, therefore, the primary object of the present invention to provide a compact and low cost recording apparatus capable of transporting and cutting a recording medium without any occurrence of paper clogging.

It is another object of the invention to provide a recording apparatus that will cut each section of a recording medium only once.

It is a further object of the invention to provide a recording apparatus that does not need feed rollers to transport cut recording paper to a storage tray.

According to the invention, there is provided a recording apparatus capable of transporting recording paper to an exit, such as a tray, without any transporting feed rollers between the cutter and the tray and without an undue risk that the paper will become clogged in the cutting device. The recording apparatus comprises a recording head for recording information on the recording paper, at least one transporting roller for transporting the recorded paper to a cutter and a control circuit for activating the cutter to cut the recording paper. After the recording operation is completed, the recording paper is moved forward to a predetermined position depending on the desired length of the recorded page. The desired point at which the paper is to be cut is moved beyond the cutter. Thereafter, the recording paper is moved back so that the desired cutting point is at the cutter. The control circuit causes the cutter to cut the recording paper at the desired cutting point. Since the tray is located just beyond the cutter, the recording paper is discharged into the tray. BRIEF

DESCRIPTION OF THE PREFERRED EMBODIMENTS

Figure 1:
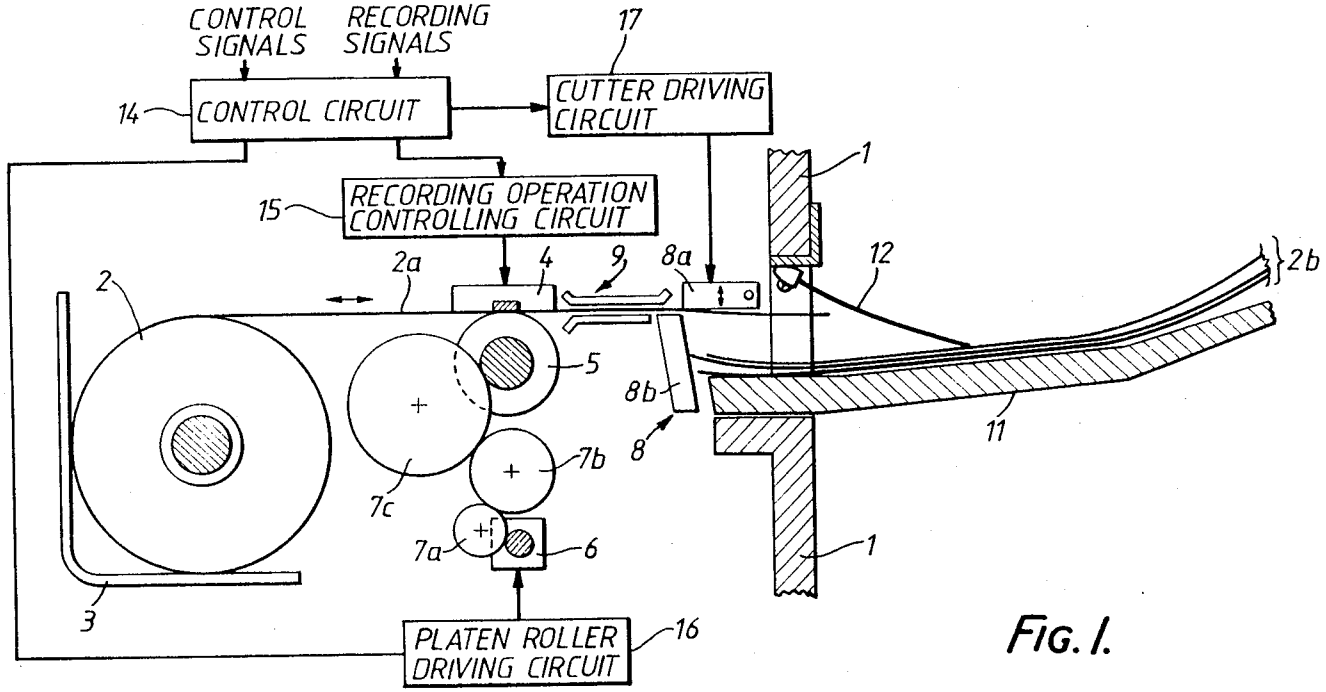
FIG. 1 is a block diagram showing a perferred embodiment of the recording apparatus according to the invention.

A preferred embodiment of this invention is shown in FIG. 1 and includes casing 1 in which thermosensitive rolled recording paper 2, recording paper holder 3, thermal recording head 4, platen roller 5, step motor 6, gears 7*a*, 7*b* and 7*c*, rotary cutter 8 and guide plates 9 are disposed. For illustrative purposes, the invention is described in a facsimile receiver. The cover frame of casing 1 has a hinged construction and platen roller 5 is brought into contact with recording head 4 when cover frame of casing 1 is closed. Recording paper 2*a*, unrolled from rolled recording paper 2, is held between platen roller 5 and recording head 4. When the cover frame is opened (turned in a counter-clockwise direction), platen roller 5 will not turn. Recording paper 2*a* is transported when platen roller 5 is rotated. Gears 7*a*, 7*b* and 7*c* transmit rotary power to platen roller 5 from step motor 6 and have predetermined gear ratios depending upon the rotary speed ratio between platen roller 5 and step motor 6. Rotary cutter 8 includes rotary blade 8*a* and stationary blade 8*b*. Recording paper 2*a* is positioned between blade 8*a* and 8*b* and is cut by a downward turn of rotary blade 8*a*. After cutting the recording paper, rotary blade 8*a* returns to its initial position. In the initial position, there is narrow space between blade 8*a* and 8*b*. Guide plates 9 guide recording paper 2*a* through the narrow space of rotary cutter 8.

The apparatus includes tray 11 installed just beyond cutter 8 and electrostatic discharger 12 installed in casing 1 by means of screw 10. Recording paper 2*a* cut off from the roll of recording paper 2 is discharged to, and stored in, tray 11. Electrostatic discharger 12 discharges static electricity on recording paper 2*a*.

The apparatus also includes electrical circuits including control circuit 14, recording operation controlling circuit 15, platen roller driving circuit 16 and cutter driving circuit 17. Control circuit 14 controlls the operations of the other circuits and includes a microcomputer which is a binary arithmetic logic device, a ROM (Read Only Memory) which stores a control program and a RAM (Random Access Memory) for storing data such as recording signals. Control circuit 14 supplies a recording enabling signal and lines of data (recording signals) to recording operation controlling circuit 15, a motor forward rotating signal and motor reversing signal to platen roller driving circuit 16, and a cutter driving signal to cutter driving circuit 17. Recording operation controlling circuit 15 includes registers for storing a line of data and semiconductor switches responsive to the recording enabling signal. Recording head 4 includes a line of heat generating elements. The line of data in the registers, each bit of which corresponds to each one of the heat generating elements, is supplied to recording head 4 by operations of the semiconductor switches. The heat elements then generate enough heat to cause the thermosensitive recording paper in contact therewith to darken. Platen roller driving circuit 16 controls the rotating operation of step motor 6. When the motor rotating signal is activated, platen roller driving circuit 16 supplies either forward or reverse rotating pulses to step motor 6. Step motor 6 and platen roller 5 rotate in a clockwise direction when forward rotating pulses are supplied and rotate in a counter-clockwise direction when reverse pulses are supplied. Therefor, recording paper 2*a* moves forward toward tray 11 or moves back toward recording head 4. During the recording operation, step motor 6 rotates in the clockwise direction after each line of the recording operation is completed. Cutter driving circuit 17 controls the cutting operation of cutter 8 and causes rotary blade 8*a* to turn downward in order to cut recording paper 2*a* when the cutter driving signal is active. Cutter driving circuit 17 also and causes rotary blade 8*a* to turn upward in order to create a narrow space between blade 8*a* and 8*b* when the cutter driving signal is inactive. Recording paper 2*a* passes through the space.

Figure 2:
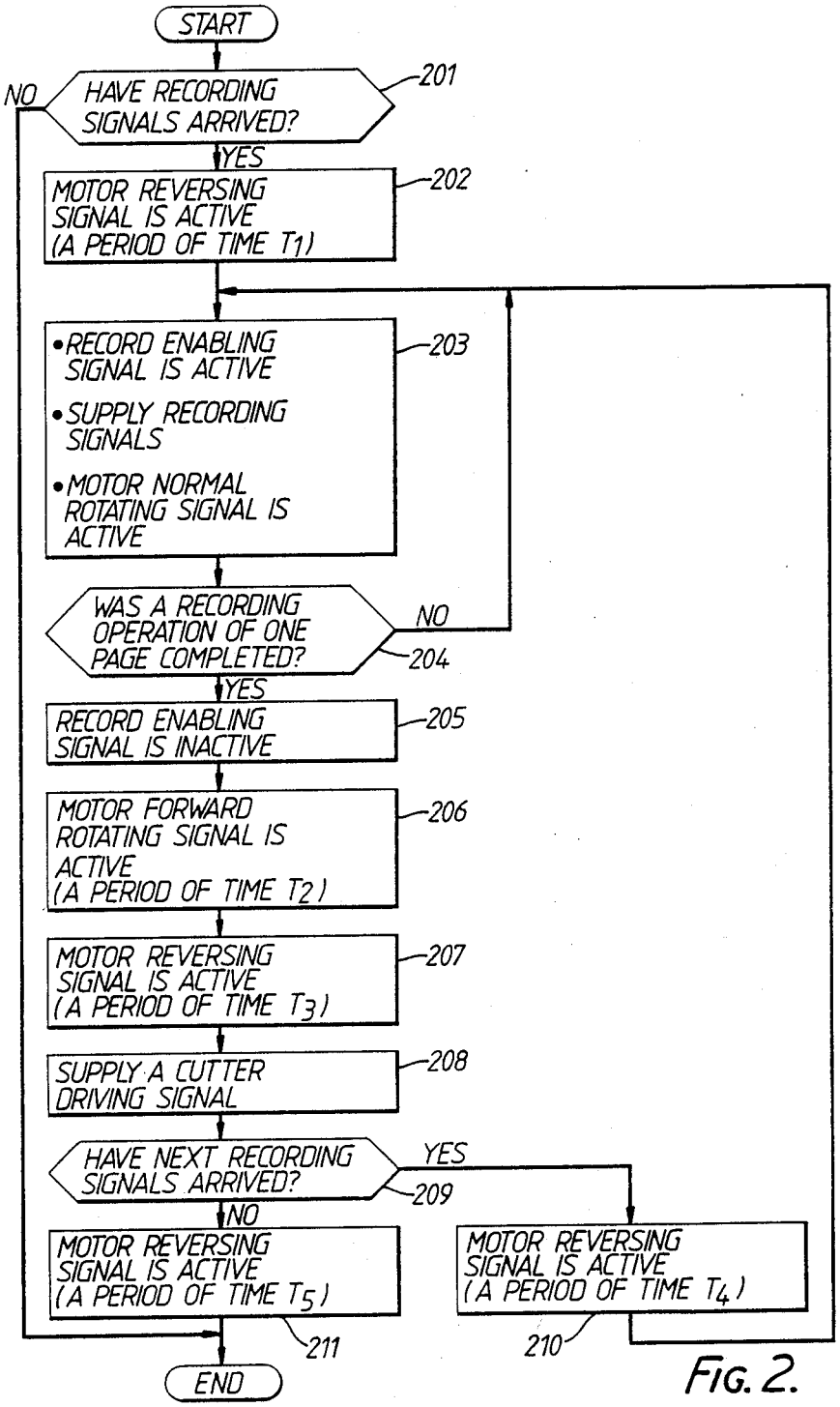
FIG. 2 is a flow chart showing the program-controlled operation of the recording apparatus of FIG. 1.
Figure 3:
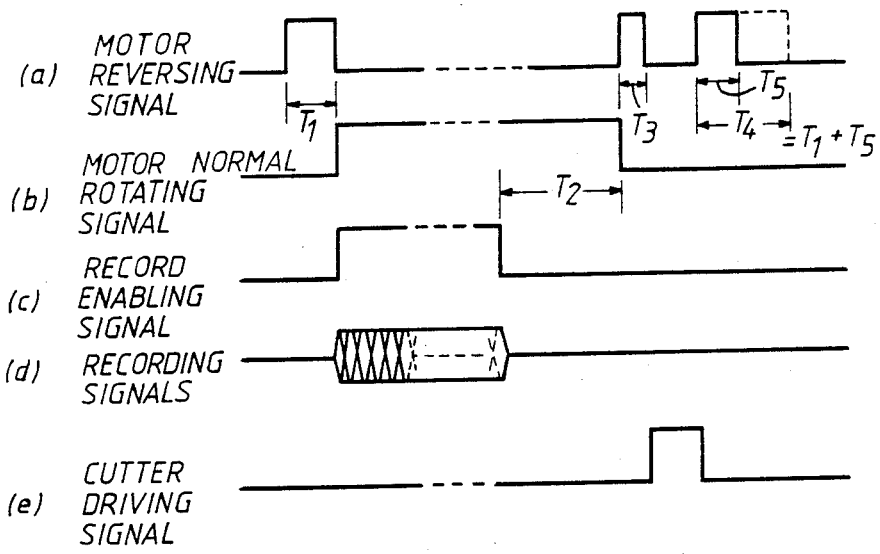
FIG. 3 is a timing chart showing the recording operation of FIG. 1.
Figure 4:
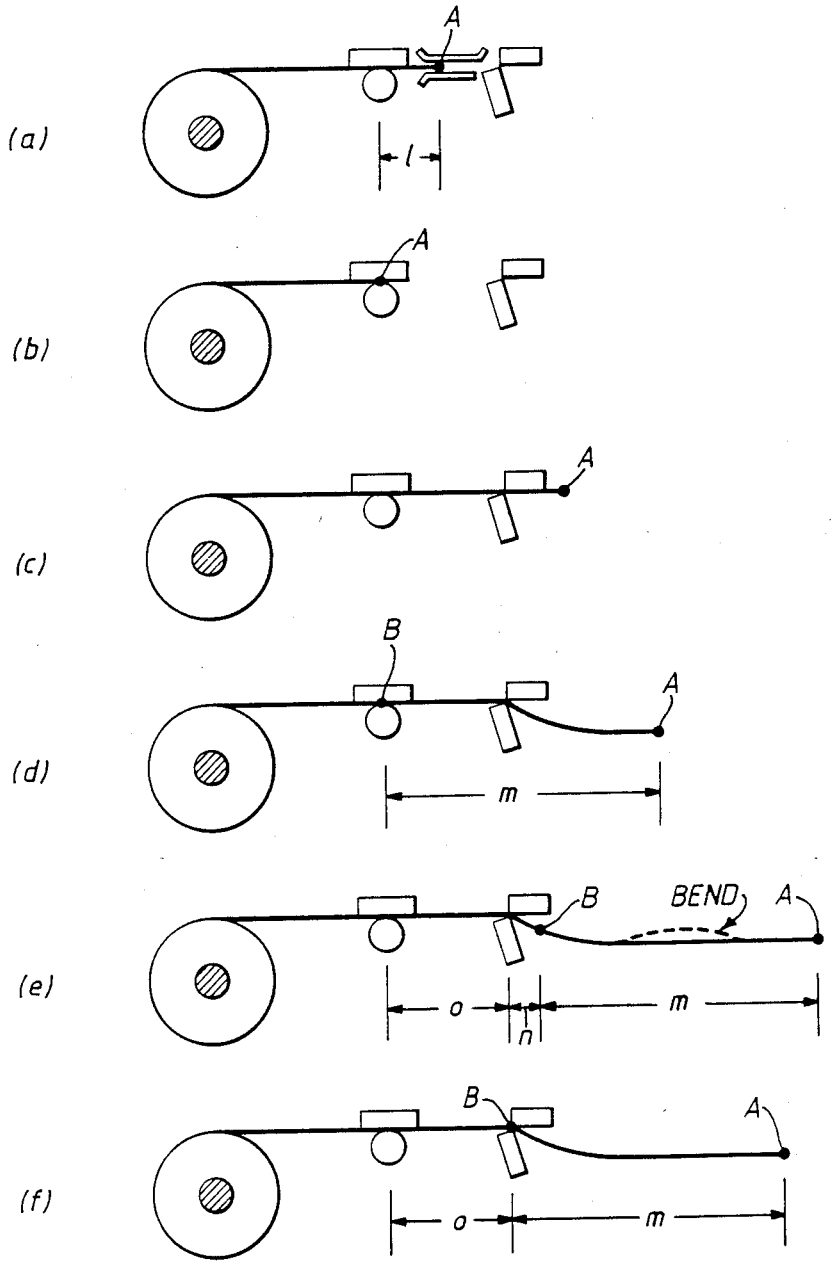
FIG. 4 is fragmented cross sectional view of the recording apparatus of FIG. 1.

The operation of a facsimile receiver having the construction described above will be described as follows with reference to the flow chart of control circuit 14 shown in FIG. 2, and the timing chart shown in FIG. 3. When the facsimile receiver receives control signals and information signals from a facimile transmitter, the receiver decodes and demodulates the information signals using the control signals and produces recording signals. The control signals and recording signals are supplied to control circuit 14. If recording signals are supplied after the control signals, control circuit 14 is responsive to these signals at step 201 and causes the motor reversing signal to be active for a period of time T1 at step 202. In an initial state (in a waiting state), the foremost end part A of the recording paper 2*a* is in guides 9 as illustrated in FIG. 4(*a*) and, after the motor reversing signal has been active for time T1, the foremost end part A comes to a recording operation starting position which is just between platen roller 5 and recording head 4 as illustrated in FIG. 4(*b*), so that recording paper 2*a* has moved back by a distance 1 (note that guides 9 are not shown in FIGS. 4(*b*)–4(*f*). A recording operation at step 203 is then carried out. At step 203 the record enabling signal becomes active resulting in recording head 4 being activated and recording signals are supplied to recording operation controlling circuit 15. Recording operation controlling circuit 15 then supplies lines of data to recording head 4 as illustrated in FIG. 3(*d*). At the same time, the motor forward signal becomes active as illustrated in FIG. 3(*b*) whereby motor 6 for controlling platen roller 5 is rotationally driven in synchronism with each line of the recording operation. Thus, the recording operation is initiated and therefater recording paper 2*a* is transported through cutter 8 during the recording operation. When control circuit 14 determines that a recording operation of one page has been completed at step 204 in FIG. 2, it causes the record enabling signal to be inactive at step 205, and recording signals are not supplied to recording head 4. A distance m shows the length of the recorded portion of paper 2*b*. The motor forward rotating signal remains active for a period of time T2 at step 206, whereby a predetermined position B (representing the desired cutting point) of the recording paper 2*a*; illustrated in FIG. 4, passes through cutter 8 by a short distance n (see FIG. 4*e*) so that recording paper 2*a* has moved forward by a distance o+n for the period of time T2. Control circuit 14 then causes the motor reversing signal to be active for a period of time T3 at step 207, and recording paper 2*a* moves back by the distance n bringing point B to the cutting position of cutter 8. Control circuit 14, at step 208, then supplies the cutter driving signal to the cutter driving circuit in order to cut recording paper 2*a* at point B as illustrated in FIG. 4(*f*). The portion of the recording paper cut off in this way is discharged into tray 11. If more recording signals are received (step 209), control circuit 14 causes the motor reversing to be active for a period of time T4 (step 210), and the new foremost end part of the recording paper 2*a* (point B) comes back to the recording operation starting position (the position indicated at point A in FIG. 4(*b*). On the other hand, if more recording signals are not received, control circuit 14 causes the motor reversing signal to be active for a period of time T5 at step 211, and the new foremost end of the recording paper comes back to the initial position (the position indicated at point A in FIG. 4(*a*)).

Figure 5:
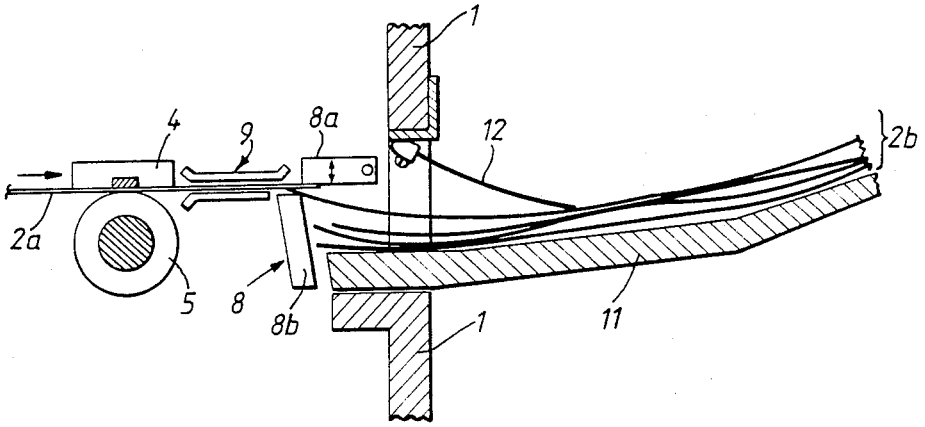
FIG. 5 is a fragmented cross sectional view of the recording apparatus of FIG. 1, particularly illustrating an occurrence of paper clogging.

According to the above-decribed embodiment, even if recording paper 2*a* bends before the cutting operation, the bend will vanish from recording paper 2*a* since point B passes through cutter 8 by a short distance n, for example about 7 mm, and is then brought back to cutter 8 by the rotating operation of platen roller 5. A bend may be caused by an electrostatic attraction between recording paper 2*a* and tray 11 or between paper 2*a* and 2*b*. Electrostatic discharger 12 (see FIG. 1) discharges the static electricity on recording paper 2*a* caused by friction between rotating platen roller 5 and recording paper 2*a*, etc., but it is not always able to discharge all of the static electricity. As a result, some static electricity may remain on recording paper 2*a*, which can cause clogging or other problems. For example, if the cutting point is transported only to the cutter 8 and the paper is cut, there may be a bend in the paper that could cause the rearmost end of the recording paper to enter into the narrow space between blade 8*a* and 8*b*. If the rearmost end does enter into this space, the next sheet of recording paper may strike against the rearmost end and paper clogging will occur as illustrated in FIG. 5. It is also possible tht paper 2*a* will be cut a second time.

Paper clogging can also occur due to the rear of recording paper 2b being cut off and becoming stuck in the blades. The present invention avoids these poroblems. Since the recording paper is first extended into the tray and then brought back before cutting, the chance of the paper bending and being forced back into the cutting slot will be greatly reduced.

The time when motor 6 starts and stops its operation and the time when cutter 8 is activated are determined with the aid of timers incorporated in control circuit 14. Alternatively, the time when components as described above start and stop their operation may be determined by processing output signals issued from a properly determined number of sensors which are disposed in spaced relation along the path of recording paper 2b in order to detect the position of the paper. Further, in the above-described embodiment, recording paper 2b is caused to move back a short distance (o-1) after the paper is cut by cutter 8 to await the next transmission of recording signals. It is not desirable to leave the paper immediately adjacent the cutter 8 since the cutter may become clogged due to the build up of short strips of paper caused by incorrect actuation of the cutter. The cutter may also rust if kept in direct contact with the coated material on recording paper 2b for a long period of time, resulting in incorrect cutting of the paper. However, if desired, recording paper 2b may be held at the cutting position.

Before completion of the cutting operation, recording paper 2b is moved back by a short distance n only once. However, if there is enough time to transport the recording paper more than once before the cutting operation, recording paper 2b may be moved forward and back repeatedly. Moving the paper back and forth several times will further decrease the likelihood of the paper being bent in the tray.

Various changes may be made within the purview of this invention in the form, details, preportions and arrangement of parts witout departing from the spirit of the invention, and no undue limitations are to be inferred or implied from the foregoing disclosure.

We claim:

1. A recording apparatus comprising:

a recording medium on which information can be recorded;

recording means for recording the information on a section of said recording medium;

transporting means for transporting said recording medium;

cutting means for cutting said section of said recording medium at a predetermined cutting point; and wherein said transporting means first transports said recording medium until said cutting point is a predetermined distance beyond said cutting means and thereafter transports said recording medium in the reverse direction until said cutting point is at said cutting means, all before said recording medium is cut by said cutting means, in order to reduce the likelihood that a bend in said section of said recording medium will interfere in the operation of said recording apparatus.

2. A recording apparatus according to claim 1 further comprising storage means for storing said sections of said recording medium that have been cut by said cutting means.

3. A recording apparatus according to claim 1 wherein said recording medium comprises a roll of recording paper.

4. A recording apparatus according to claim 1 wherein said storage means comprises a tray.

5. A recording apparatus according to claim 1 wherein said cutting means comprises a rotary cutter including a rotary blade and a stationary blade.

6. A recording apparatus according to claim 1 wherein said transporting means comprises a motor capable of forward and reverse rotation, a platen roller and transmitting means for transmitting the rotation of said motor to said platen roller, said recording medium being held between and moved by said recording means and said platen roller.

7. A recording apparatus according to claim 1 further comprising guide means for guiding said recording medium to said cutting means.

8. A recording apparatus according to claim 1 wherein said transporting means transports said recording medium from said roll of recording paper to said recording means and from said recording means to said cutting means.

9. A recording apparatus according to claim 1 wherein said transporting means transports said cutting point of said recording medium beyond said cutting means and then back to said cutting means a plurality of times.

10. A method of transporting a recording medium in a recording device comprising the steps of:

recording information on a section of said recording medium;

transporting said recording medium to a cutting device;

cutting said section of said recording medium at a predetermined cutting point; and wherein said step of transporting comprises first transporting said recording medium until said cutting point is a predetermined distance beyond said cutting device and then transporting said recording medium in the reverse direction until said cutting point is located at said device, all before said recording medium is cut at said cutting point, in order to reduce the likelihood that a bend in said section of said recording medium will interfere in the operation of said recording apparatus.

11. The method according to claim 10 wherein said recording medium comprises a roll of recording paper.

12. The method according to claim 10 wherein said step of transporting comprises transporting said cutting point of said recording medium beyond said cutting device and then back to said cutting device a plurality of times before said step of cutting.

13. The method according to claim 10 wherein after said step of cutting said recording medium the unsevered portion of the recording medium is transported in said reverse direction a predetermined distance.

* * * * *